US011828501B2

(12) United States Patent
Nawaz et al.

(10) Patent No.: US 11,828,501 B2
(45) Date of Patent: Nov. 28, 2023

(54) METAL FOAM HEAT EXCHANGERS FOR AIR AND GAS COOLING AND HEATING APPLICATIONS

(71) Applicants: UT-Battelle, LLC, Oak Ridge, TN (US); Board of Trustees of the University of Illinois, Urbana, IL (US)

(72) Inventors: Kashif Nawaz, Oak Ridge, TN (US); Anthony M. Jacobi, Urbana, IL (US)

(73) Assignees: UT-BATTELLE, LLC, Oak Ridge, TN (US); Board of Trustees of the University of Illinois, Urbana, IL (US)

( * ) Notice: Subject to any disclaimer, the term of this patent is extended or adjusted under 35 U.S.C. 154(b) by 504 days.

(21) Appl. No.: 16/942,853

(22) Filed: Jul. 30, 2020

(65) Prior Publication Data

US 2021/0033318 A1 Feb. 4, 2021

Related U.S. Application Data

(60) Provisional application No. 62/880,126, filed on Jul. 30, 2019.

(51) Int. Cl.
*F25B 39/02* (2006.01)
*F28F 1/12* (2006.01)
(Continued)

(52) U.S. Cl.
CPC ..... *F25B 39/028* (2013.01); *F28D 1/05391* (2013.01); *F28F 1/128* (2013.01); *F28D 2021/0071* (2013.01)

(58) Field of Classification Search
CPC ..... F25B 39/028; F28D 1/05391; F28D 2021/0071; F28F 1/128
(Continued)

(56) References Cited

U.S. PATENT DOCUMENTS 8,127,829 B2 * 3/2012 Sabatino ..... F28F 13/003 165/181
9,279,626 B2 * 3/2016 Berukhim ..... F28F 9/028
(Continued)

OTHER PUBLICATIONS

Nawaz, Kashif, Jessica Bock, and Anthony M. Jacobi. "Thermal-hydraulic performance of metal foam heat exchangers under dry operating conditions." Applied Thermal Engineering. 119 (2017): 222-232.

(Continued)

*Primary Examiner* — Tho V Duong
*Assistant Examiner* — Raheena R Malik
(74) *Attorney, Agent, or Firm* — WARNER NORCROSS + JUDD LLP

(57) ABSTRACT

Improved heat exchangers according to several embodiments are provided. The heat exchangers provide improved heat transfer for air flow in wet and dry operating conditions, while minimizing pressure drop across the heat exchanger in some applications. According to one embodiment, an improved heat exchanger includes a plurality of metal foam fins between adjacent heat exchange conduits, the heat exchange conduits being arranged parallel to each other to define parallel flow paths between an inlet header and an outlet header. The metal foam fins occupy a cross-flow region between adjacent conduits, the fins having a fixed angular orientation or being rotatable in unison to vary the thermal capacitance of the heat exchanger.

8 Claims, 5 Drawing Sheets

(51) Int. Cl.
*F28D 1/053* (2006.01)
*F28D 21/00* (2006.01)

(58) Field of Classification Search
USPC ..... 165/181
See application file for complete search history.

(56) References Cited

U.S. PATENT DOCUMENTS 9,664,459 B2 * 5/2017 Wilding ..... F28F 9/02
9,951,997 B2 * 4/2018 Maurer ..... F28F 13/003
2004/0226702 A1 11/2004 Toonen et al.
2005/0178534 A1 * 8/2005 Kienbock ..... F28F 13/003 165/181
2005/0250065 A1 * 11/2005 Carbone ..... F23D 14/06 431/354
2008/0296008 A1 * 12/2008 Kim ..... F28F 13/003 165/182
2009/0084520 A1 4/2009 Champagna et al.
2012/0199330 A1 * 8/2012 Maurer ..... F28D 7/1669 165/172
2012/0199331 A1 * 8/2012 Maurer ..... F28D 7/024 165/172
2012/0199334 A1 * 8/2012 Maurer ..... F28F 13/003 165/185
2012/0199335 A1 * 8/2012 Maurer ..... F28D 7/0058 165/185
2013/0146437 A1 * 6/2013 Maurer ..... F28F 13/003 165/181
2014/0284020 A1 * 9/2014 Amir ..... F28D 20/021 165/10
2015/0060031 A1 3/2015 Dietrich et al.
2021/0033318 A1 * 2/2021 Nawaz ..... F28F 1/12
2021/0154610 A1 * 5/2021 Carredo ..... A62B 23/02
2021/0389061 A1 * 12/2021 Nawaz ..... B01B 1/06

OTHER PUBLICATIONS

Nawaz, Kashif, Jessica Bock, and Anthony M. Jacobi. "Thermal-hydraulic performance of metal foam heat exchangers." International Refrigeration and Air Conditioning Conference (Jul. 16-19, 2012), Purdue University e-Pubs., 2395, pp. 1-10.

* cited by examiner

METAL FOAM HEAT EXCHANGERS FOR AIR AND GAS COOLING AND HEATING APPLICATIONS

CROSS-REFERENCE TO RELATED APPLICATIONS

This application claims the benefit of U.S. Provisional Application 62/880,126, filed Jul. 30, 2019, the disclosure of which is incorporated by reference in its entirety.

STATEMENT REGARDING FEDERALLY SPONSORED RESEARCH AND DEVELOPMENT

This invention was made with government support under Contract No. DE-AC05-00OR22725 awarded by the U.S. Department of Energy. The government has certain rights in the invention.

FIELD OF THE INVENTION

The present invention relates to heat exchangers, and in particular, metal foam heat exchangers for transferring heat between two fluid streams.

BACKGROUND OF THE INVENTION

Heat exchangers are devices that transfer heat between two fluid streams at different temperatures. Heat transfer is typically accomplished by convection in each fluid stream and conduction through a barrier separating the two fluid streams. Heat exchangers are critical in many applications, including space heating, air conditioning, refrigeration, and dehumidification. Conventional heat exchangers include shell and tube, bayonet, concentric tube, plate, and spiral plate, each being a type of indirect-contact heat exchanger.

Metal foam heat exchangers are a further category of indirect-contact heat exchangers, showing great promise for many commercial and industrial applications. Metal foams have attractive properties for heat transfer applications and provide an extended surface with high surface area and complex flow paths. The open porosity, low relative density, high thermal conductivity, and large accessible surface area per unit volume contribute to making metal foam thermal management devices efficient, compact, and lightweight.

Metal foam heat exchangers are characterized by the size of the windows, or pore diameter, which correlates to the nominal pore density (usually as pores per inch or PPI), the strut diameter and length, and the porosity (volume of void divided by the total volume of the solid matrix and void). Aluminum has been used as the primary material for metal foams due to its low density, high thermal conductivity, and low price. However, there remains a continued need for improved heat exchangers, and in particular, metal foam heat exchangers suitable for use under wet and dry operating conditions for a variety of commercial applications.

SUMMARY OF THE INVENTION

Improved heat exchangers according to several embodiments are provided. The improved heat exchangers provide excellent heat transfer for air flow in wet and dry operating conditions and strike a favorable balance between thermal capacitance and pressure differential. The improved heat exchangers perform well in wet operating conditions, reducing the risk of condensate blow-off and frost formation during operation in cold temperatures.

According to one embodiment, an improved heat exchanger includes a plurality of metal foam fins between adjacent heat exchange conduits, the heat exchange conduits being arranged parallel to each other to define parallel flow paths between an inlet header and an outlet header. The metal foam fins occupy a cross-flow region between adjacent conduits, the metal foam fins being fixed or being rotatable in unison to vary the thermal capacitance of the heat exchanger. The metal foam fins extend between, and interconnect, exteriors surfaces of adjacent heat exchange conduits, which optionally include a rectangular cross-section. The metal foam fins comprise unitary metal foam bodies, optionally formed from aluminum, copper, nickel, silver, gold, or alloys thereof. The angular orientation of each fin can be adjusted in unison in a first direction to raise the thermodynamic capacitance of the heat exchanger and adjusted in unison in a second direction to lower the thermodynamic capacitance of the heat exchanger, while simultaneously raising or lowering the pressure differential across the heat exchanger.

According to another embodiment, an improved heat exchanger includes a metal foam body joined to and encapsulating the exterior surface of at least two heat exchange conduits in a region between a first header and a second header. The metal foam body completely occupies a cross-flow region along a lengthwise portion of the heat exchange conduits, being centrally disposed between the first header and the second header. The metal foam body is optionally a unitary cuboid having a rectangular cross-section, being formed from aluminum, copper, nickel, silver, gold, or alloys thereof. The heat exchange conduits can include any desired cross-section, including for example a circular cross-section, an elliptical cross-section, or a rectangular cross-section. The heat exchange conduits pass through an interior portion of the metal foam body, defining parallel flow paths between the inlet header and the outlet header.

According to another embodiment, an improved heat exchanger includes a plurality of wire mesh sections disposed in the cross-flow regions between parallel heat exchange conduits. The wire mesh sections completely occupy the cross-flow regions, providing a porous media through which air can pass with a lower pressure differential as compared to metal foam. The wire mesh sections are formed from a heat conductive metal and are generally more porous than the metal foam heat exchangers discussed herein.

These and other features and advantages of the present invention will become apparent from the following description of the invention, when viewed in accordance with the accompanying drawings and appended claims.

DETAILED DESCRIPTION OF THE CURRENT EMBODIMENTS

I. Heat Exchanger Configuration

Figure 1:
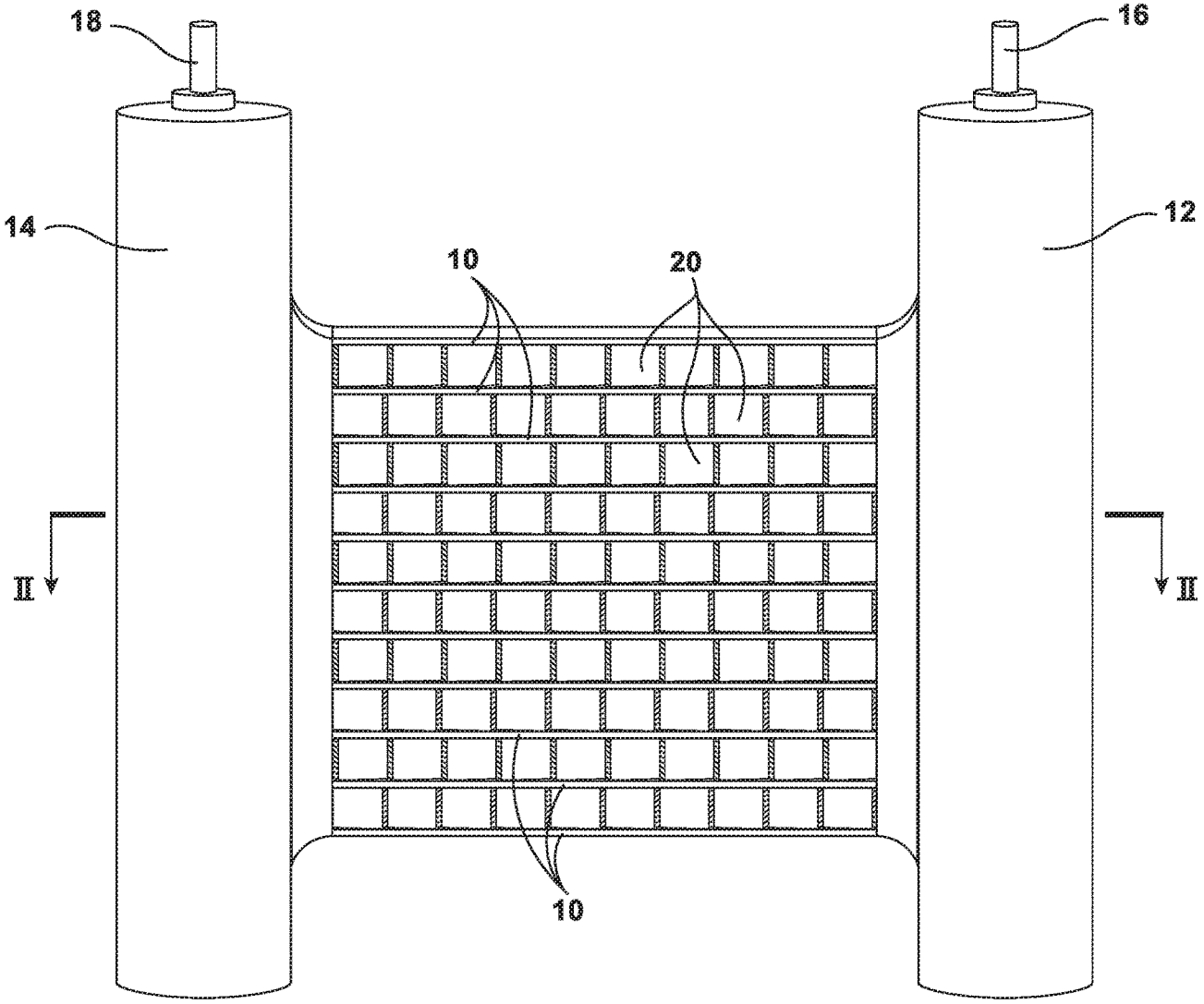
FIG. 1 is a side elevation view of a heat exchanger in accordance with a first embodiment of the present invention.

The heat exchangers of the current embodiments, illustrated in FIGS. 1-5, generally include a plurality of heat exchange conduits 10 that are arranged parallel to each other to define internal flow passages between an inlet header 12 and an outlet header 14. The parallel flow conduits 10 promote the transfer of heat between a first fluid (generally air) moving over the parallel flow conduits 10 and a second fluid moving through the parallel flow conduits 10. Metal foam or wire mesh is between adjacent parallel flow conduits 10 to improve the thermal conductivity of the heat exchangers in both dry and wet operation conditions.

More specifically, the parallel flow conduits 10 are arranged at a distance from one another to define a cross-flow region therebetween. The parallel flow conduits 10 are tube-like flow passages with any cross-sectional shape, for example rectangular, circular, or elliptical cross-sections. The second fluid may include liquids, gases, or a combination of liquids and gases. For example, the second fluid can include air, water, or refrigerant. The parallel flow conduits 10 can be manufactured of copper, aluminum, steel, or other metal or metal alloys to facilitate the transfer of heat from the first fluid to the second fluid.

The inlet header 12 and the outlet header 14 are hollow members that distribute the second fluid to the plurality of flow passages or that collect the second fluid from the plurality of flow passages. The inlet header 12 includes an inlet 16 and a first plurality of fluid ports as input ends for the plurality of internal flow passages. The outlet header 14 and includes an output port 18 and a second plurality of fluid ports as output ends for the plurality of internal flow passages. The parallel flow conduits 10 are illustrated as providing separate flow paths between the inlet header 12 and the outlet header 14, but can be modified to provide a single flow path, optionally as a single heat exchange conduit following a serpentine pattern for guiding the second fluid between the inlet header 12 and the outlet header 14.

II. Metal Foam Fins Separating Adjacent Flow Conduits

Figure 2:
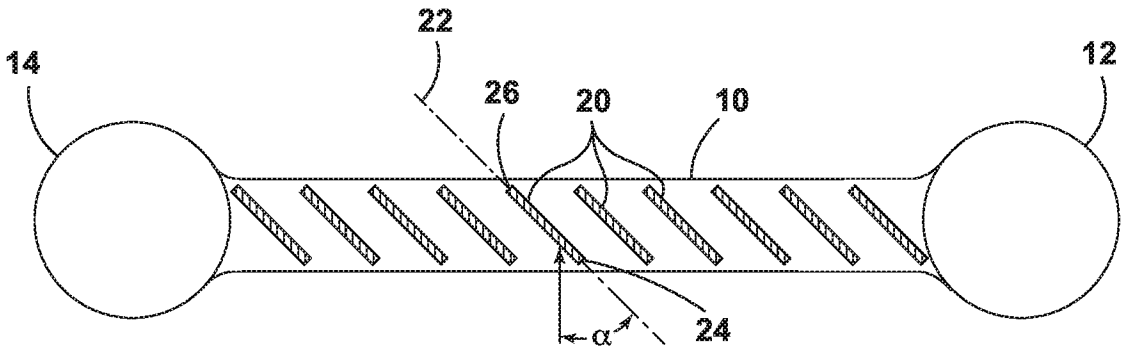
FIG. 2 is a cross-sectional view of a heat exchanger taken along line II-II of FIG. 1.

Referring now to FIGS. 1-2, a heater exchanger in accordance with a first embodiment is illustrated. As noted above, the heat exchanger includes a plurality of flow conduits 10, arranged parallel to each other, that form a plurality of flow passages for guiding a second fluid from an inlet header 12 to an outlet header 14. A plurality of metal foam fins 20 interconnect the exterior surfaces of adjacent flow conduits and are positioned in the cross-flow region between adjacent flow conduits. In some applications, the metal foam fins 20 are selectively rotatable about a vertical pivot axis that runs perpendicular to the lateral flow passages defined by the plurality of parallel flow conduits 10. Consequently, the metal foam fins 20 include a frontal surface area that varies from a maximum surface area (the fins being approximately perpendicular to the flow direction of the first fluid) to a minimum surface area (the fins being approximately parallel to the flow direction of the first fluid).

More specifically, and as shown in FIG. 2, an angle of incidence a is defined between a flow direction of an incoming fluid flow and an axis 22 connecting a proximal edge 24 and a distal edge 26 of each metal foam fin 20. In some embodiments, the angle of incidence a can be increased for each metal foam fin 20, either in collectively or independently, to achieve the desired frontal surface area in the cross-flow region between each adjacent flow conduit 10. The angle of incidence a is depicted as 45-degrees in FIG. 2. The angle of incidence a can be increased to a maximum of approximately 90 degrees, such that the frontal surface area is at its maximum, completely filling each cross-flow region between adjacent flow conduits. The angle of incidence a can be likewise decreased to a minimum of approximately 0 degrees, such that the frontal surface area is at its minimum, with only the proximal edges 24 of the metal foam fins comprising the frontal surface area between adjacent conduits 10. The angle of incidence can be varied to any intermediate value, for example, 30 degrees or 60 degrees, to achieve a desired balance in frontal surface area and pressure drop.

Alternative rows of metal foam fins 20 are angled oppositely from each other as shown in FIG. 1. In particular, alternating rows of metal foam fins 20 are open toward the inlet header 12 or the outlet header 14. Each metal foam fin 20 includes the same dimensions, having a uniform front-to-back thickness, height, and width. Each row includes ten fins in the current embodiment, but can include greater or fewer numbers in other embodiments. The metal foam fins 20 can also be made to include a fixed angular orientation, optionally being bonded to adjacent conduits 10 using a thermal compound. Alternatively, the heat exchanger can be formed by brazing the metal foam fins 20 to adjacent conduits 10, optionally using silver, copper, tin, or magnesium. The heat exchanger can also be formed by welding the metal foam fins 20 to adjacent, spaced apart conduits, such that the metal foam fins 20 are fixed in position and define a constant frontal surface area within each cross-flow region.

The parallel flow conduits 10 each define a rectangular cross-section in the current embodiment, such that the metal foam fins 20 extend between and interconnect opposing major surfaces of adjacent flow conduits 10. The metal foam fins 20 define a rectangular body having a height approximately equal to the distance separating adjacent flow conduits 10. Each fin is a monolithic metal foam body, while in other embodiments each fin can include a metal core structure that is coated with a metal foam exterior. Suitable metal foams can include aluminum, copper, nickel, silver, gold, and alloys thereof. The metal foam fins 22 can include a desired pore density, for example less than and including 100 PPI, further optional less than and including 10 PPI, still further optionally less than and including 5 PPI.

As one non-limiting example, a heat exchanger in accordance with the current embodiment was constructed. The heat exchanger included eleven rectangular flow conduits and ten rows of ten metal foams fins each, for a total of 100 metal foam fins. Each metal foam fin was formed from copper alloy and bonded to adjacent metal flow conduits using a high-density polysynthetic silver thermal compound from Artic Silver, Inc., with a fixed angle of incidence of 45 degrees. The metal foam fins included a pore density of 80 PPI, a fin height of 15 mm, a fin width of 15 mm, a fin thickness of 1 mm. The cross-flow region between each flow conduit was 15 mm, and the side-to-side width of each flow conduit was 25 mm.

III. Metal Foam Block Surrounding Adjacent Flow Conduits

Figure 3:
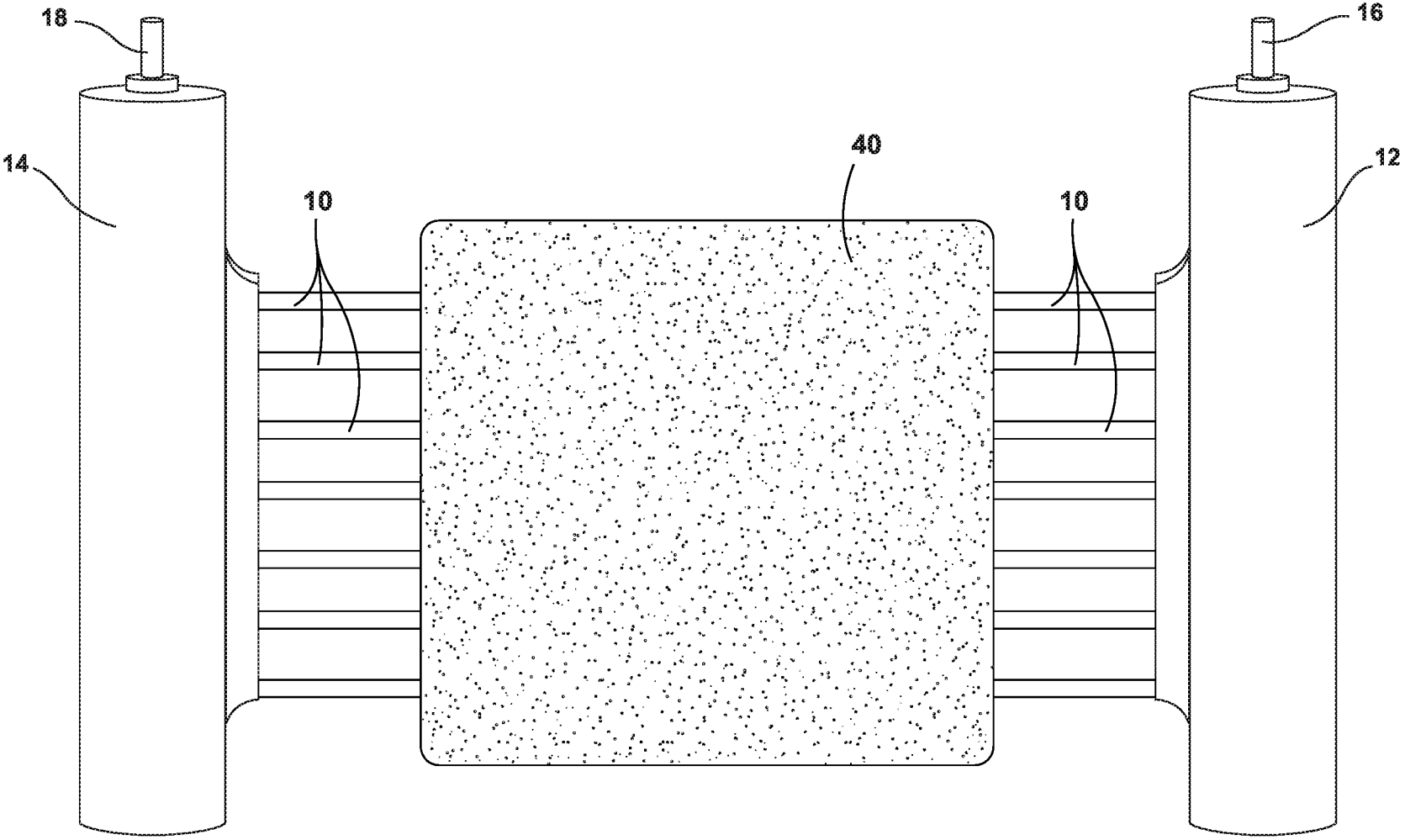
FIG. 3 is a side elevation view of a heat exchanger in accordance with a second embodiment of the present invention.
Figure 4:
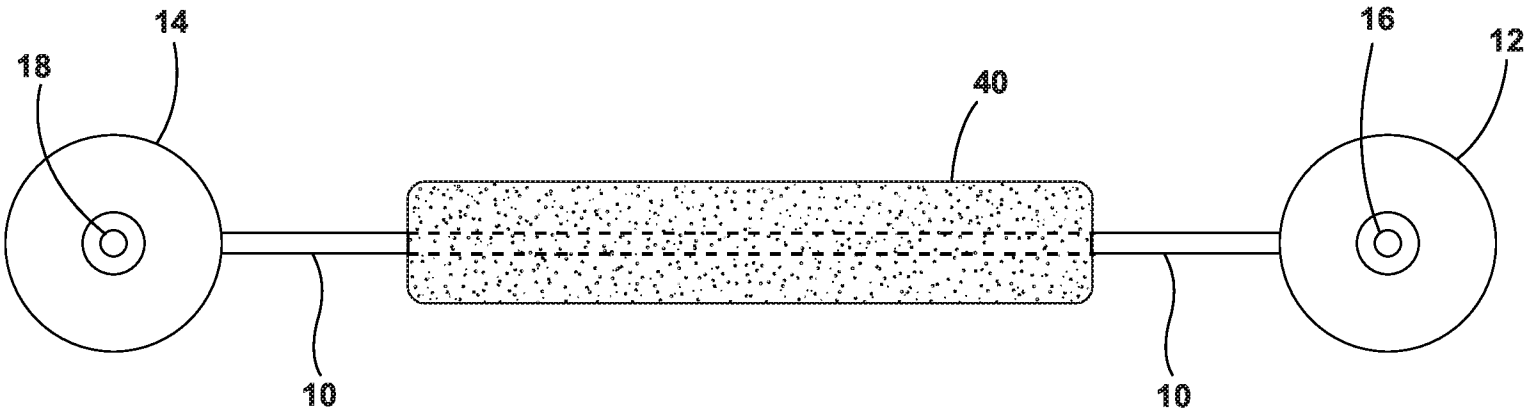
FIG. 4 is a top plan view of the heat exchanger of FIG. 3.

Referring now to FIGS. 3-4, a heater exchanger in accordance with a second embodiment is illustrated. Similar to the first embodiment, the heat exchanger includes a plurality of flow conduits 10, arranged parallel to each other, that form a plurality of flow passages for guiding the second fluid from an inlet header 12 to an outlet header 14. The heat exchanger includes a metal foam body 40 joined to and encapsulating the exterior surface of each of the plurality of flow conduits 10 in a central region between inlet header 12 and the outlet header 14. The use of metal foam provides an enlarged heat-exchanging surface area and increased conduction, with higher flow resistance however and consequently an increased pressure drop across the heat exchanger. The metal foam is optionally aluminum, copper, nickel, silver, gold, and alloys thereof.

As illustrated in FIGS. 3-4, the metal foam body 40 is a unitary cuboid having a rectangular cross-section. The flow conduits 10 have a circular cross-section, but can include other cross-sections in other embodiments, for example an elliptical cross-section or a rectangular cross-section. The flow conduits 10 pass through the interior of the metal foam body 40, defining parallel flow paths between the inlet header 12 and the outlet header 14. Stated differently, the metal foam body 40 comprises a body of metal foam through which the parallel flow passages traverse. The metal foam body 40 includes a open cell structure, optionally with a uniform pore density. The metal foam body can encapsulate all or a portion of the parallel conduits 10, and in particular the region between adjacent conduits 10. The metal foam body 40 can be bonded to the conduits 10 using a thermal epoxy or a brazing process. The outer wall of the flow conduits are in heat-transferring contact with the metal foam body, which as noted above surrounds the flow conduits as a monolithic metal foam body having a rectangular cross-section.

In one example, a heat pump includes the heat exchanger of FIGS. 3-4 for transferring heat from a first fluid to a second fluid. The heat exchanger includes seven flow conduits 10 for the second fluid, the flow conduits 10 being parallel to one another and at a distance from one another and including a tube diameter of 3.5 mm. The outer walls of the flow conduits 10 are in contact with, and entirely surrounded by, the porous metal foam body 40 along a substantial portion of the length of the flow conduits 10. The porous metal foam body 40 surrounds the flow conduits as a monolithic element having a rectangular cross-section and a face area of approximately 102×102 $mm^2$. The porous metal foam body 40 can be formed of aluminum alloy or copper alloy, with a pore density of 10 PPI, 20 PPI, or 40 PPI.

IV. Wire Mesh Separating Adjacent Flow Conduits

Figure 5:
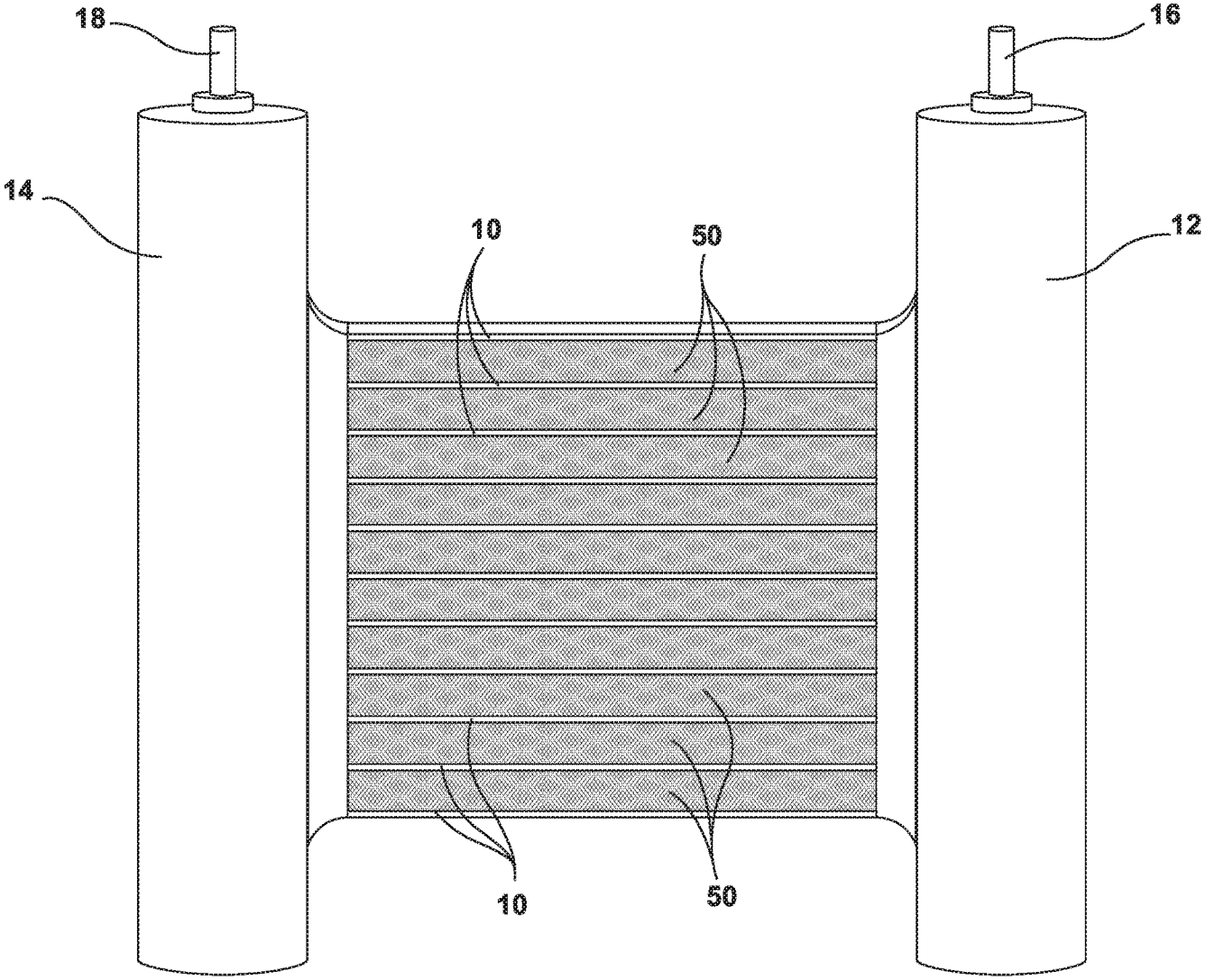
FIG. 5 is a side elevation of a heat exchanger in accordance with a third embodiment of the present invention.

Referring now to FIG. 5, a heater exchanger in accordance with a third embodiment is illustrated. The heat exchanger includes a plurality of flow conduits 10, arranged parallel to each other, that form a plurality of flow passages for guiding the second fluid from an inlet header 12 to an outlet header 14. A plurality of wire mesh sections 50 interconnect the exterior surfaces of adjacent flow conduits and are positioned in the cross-flow region between adjacent flow conduits, being in contact with the first fluid (generally air). The wire mesh sections 50 include a frontal surface area occupying substantially the entire region between each adjacent flow conduit 10. The wire mesh sections 50 provide a porous media through which the first fluid can pass, having a lower pressure drop than the first and second embodiments. However, the thermal capacitance of this embodiment was determined to be less than the thermal capacitance of the first and second metal foam embodiments.

As one non-limiting example, heat exchangers in accordance with the current embodiment were constructed. The heat exchangers included eleven rectangular flow conduits and ten sections of wire mesh in the cross-flow region between adjacent flow conduits. Each wire section was formed from copper alloy or stainless steel (64 W/m-K) with a wire diameter of 0.3 mm. The wire mesh sections included a thickness of 10 mm, being coextensive with the rectangular fins in front-to-back depth, and were bonded to adjacent flow conduits using a high-density polysynthetic silver thermal compound from Artic Silver, Inc. The flow conduits include a tube diameter of 10 mm, a tube thickness of 0.5 mm. The total frontal area of the heat exchangers was 200 mm×150 mm.

The above description is that of current embodiments of the invention. Various alterations and changes can be made without departing from the spirit and broader aspects of the invention as defined in the appended claims, which are to be interpreted in accordance with the principles of patent law including the doctrine of equivalents. Any reference to elements in the singular, for example, using the articles "a," "an," "the," or "said," is not to be construed as limiting the element to the singular.

The invention claimed is:

1. A heat exchanger comprising:

a plurality of flow conduits in fluid communication with an inlet header and an outlet header, the plurality of flow conduits including first and second flow conduits extending parallel to each other and defining a first cross-flow region therebetween, the plurality of flow conduits extending orthogonal to a lengthwise axis of the inlet header and a lengthwise axis of the outlet header; and a first plurality of fins disposed in the first cross-flow region between the first flow conduit and the second flow conduit, wherein each of the plurality of fins are rectangular and include an upper edge in direct physical contact with the first flow conduit and a lower edge in direct physical contact with the second flow conduit, the first plurality of fins being formed from metal foam wherein adjacent ones of the first plurality of fins are spaced apart from each other and having a common angular orientation, wherein the common angular orientation of each of the first plurality of fins is a non-zero angle of between 30 and 60 degrees as defined between a flow direction of an incoming fluid flow and an axis connecting a leading edge and a trailing edge of each of the plurality of fins, the leading edge and the trailing edge interconnecting the upper edge and the lower edge of the corresponding fin.

2. The heat exchanger of claim 1 wherein the angular orientation of each of the first plurality of fins is adjustable.

3. The heat exchanger of claim 1 wherein the plurality of flow conduits includes a third conduit extending parallel to the second conduit to define a second cross-flow region therebetween, the heat exchanger further including a second plurality of fins disposed in the second cross-flow region, wherein each of the second plurality of fins are formed from metal foam and are spaced apart from each other and have the common angular orientation.

4. The heat exchanger of claim 1 wherein the inlet header includes an inlet and is in fluid communication with each of the plurality of flow conduits, and wherein the outlet header includes an outlet and is in fluid communication with each of the plurality of flow conduits.

5. The heat exchanger of claim 1 wherein each of the first and second flow conduits define a rectangular cross-section, the first plurality of fins extending between and contacting a major surface of the first flow conduit and a major surface of the second flow conduit.

6. The heat exchanger of claim 1 wherein each of the plurality of fins comprises a monolithic metal foam body.

7. The heat exchanger of claim 1 wherein each of the plurality of fins is formed from metal foam comprising aluminum, copper, nickel, silver, gold, or alloys thereof.

8. The heat exchanger of claim 1 wherein each of the plurality of fins is formed from metal foam defining a pore density of not more than 100 pores per inch.

* * * * *